US005654065A

United States Patent [19]

Kishi

[11] Patent Number: 5,654,065

[45] Date of Patent: Aug. 5, 1997

[54] COMPOSITE ELASTIC LAYER

[75] Inventor: Shigeo Kishi, Osaka, Japan

[73] Assignee: Reittec Co., Ltd., Yao, Japan

[21] Appl. No.: 704,359

[22] Filed: Aug. 28, 1996

Related U.S. Application Data

[63] Continuation of Ser. No. 270,642, Jul. 1, 1994, abandoned.

[51] Int. Cl.[6] ..... B32B 3/02; B32B 33/00

[52] U.S. Cl. ..... 428/86; 428/88; 428/89; 428/92; 428/93; 428/96

[58] Field of Search ..... 428/86, 88, 89, 428/96, 92, 93

[56] References Cited

U.S. PATENT DOCUMENTS

| | | | |
|---|---|---|---|
| 3,026,830 | 3/1962 | Bryant et al. . | |
| 3,042,564 | 7/1962 | Hankins | 428/86 |
| 3,383,243 | 5/1968 | Di Gioia et al. . | |
| 3,481,821 | 12/1969 | Brunner et al. | 428/86 |
| 3,860,469 | 1/1975 | Gregorian et al. | 428/86 |
| 3,951,718 | 4/1976 | Gonzalez | 428/86 |
| 4,324,824 | 4/1982 | Narens et al. | 428/92 |

FOREIGN PATENT DOCUMENTS

| | | |
|---|---|---|
| 1-322170 | 12/1989 | Japan . |
| 4-18171 | 1/1992 | Japan . |

OTHER PUBLICATIONS

"Advanced Textile Design", William Watson, p. 404.

*Primary Examiner*—Terrel Morris
*Assistant Examiner*—Elizabeth M. Cole
*Attorney, Agent, or Firm*—Darby & Darby

[57] ABSTRACT

A composite elastic layer, which has improved resistance to shear force and functions both as a cushioning material and as a sound proof material, is comprised of a loop pile tufted fabric, which is made from a backing fabric and a plurality of loop piles. An elastomer composition is applied to the pile stratum of the loop pile tufted fabric. The elastomer composition infiltrates into voids between fibers of the loop pile, and forms a solid skin on the fibers of the loop pile. The composite elastic layer reinforces the elastic property of the loop pile, and on the other hand, the fiber of the loop pile also reinforces the tensile strength, especially the resistance to tearing, of the solid skin.

7 Claims, 3 Drawing Sheets

COMPOSITE ELASTIC LAYER

This is a continuation of application Ser. No. 08/270,642, filed Jul. 1, 1994, abandoned.

FIELD OF THE INVENTION

The present invention relates to composite elastic materials. More particularly, the present invention relates to composite elastic layers for use as cushioning materials such as floor coverings, floor carpetings and floor underlayers, or as sound proof materials such as vibration proof materials, impulse sound proof materials, sound absorbing materials and sound insulation materials.

BACKGROUND OF THE INVENTION

A pile fabric which is conventionally used as a floor covering or carpeting, has a sound absorbing property and is used as a sound absorbing material by covering walls or surfaces on which sound may be radiated. However, pile fabric is not well suited for use as a floor covering underlay, a cushioning or as a sound proof material. This is because conventional pile fabrics have inferior elasticity when compared to cellular plastic material, which is conventionally used for a cushioning or sound proof material. Cellular plastic is generally formed from thermoplastic liquid resin composition such as latex, vinyl resin-based emulsion and polyvinyl chloride-based sol.

On the other hand, a cellular plastic material is not suited for use as a covering, though it is adapted for use as a floor covering cushion underlay, since it is not adequately scuff resistant for use in the floor area. Further, it is well known that a viscoelastic material, formed from atactic polypropylene or bitumen composition, is suitable for use as a vibration and impulse sound proof material, but is not applicable for covering of an engine of a car, since it is not heat resistant. Additionally, both cellular plastic materials and viscoelastic materials are inferior in tensile strength and are easily exfoliated between their two (upper and lower) surfaces.

It is therefore a principal object of the present invention to provide an improved elastic layer usable for both cushioning materials, such as floor coverings and sound proof materials, such as impulse sound proof materials.

It is a further object of the present invention to provide improved cellular plastic materials having substantially improved resistance to shear force, tearing or exfoliation with an application of a loop pile fabric to them.

It is a further object of the present invention to provide an improved floor covering having improved physical properties.

SUMMARY OF THE INVENTION

The above and other objects of the present invention are realized by providing a composite elastic layer comprised of a loop pile tufted fabric, which is made from a backing fabric and a plurality of loop piles tufted to form a pile stratum on the backing fabric. An elastomer composition is applied on the pile stratum of the loop pile tufted fabric such that the elastomer composition infiltrates into the voids between fibers of the loop pile. The elastomer composition is preferably applied in a manner such that a space remains between at least some pile rows of the loop pile tufted fabric so as to form a grain in a body together with the loop pile.

The elastomer composition is further preferably applied such that at least some microscopic voids remain between some adjacent fibers of the loop pile so as to form microscopic voids surrounded by the skin of the elastomer composition in the interior of the loop pile, and to link the fibers of the loop pile to form a three-dimensional mesh structure in the interior of the loop pile.

BRIEF DESCRIPTION OF THE DRAWING

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PRESENTLY PREFERRED EXEMPLARY EMBODIMENTS OF THE PRESENT INVENTION

Figure 1:
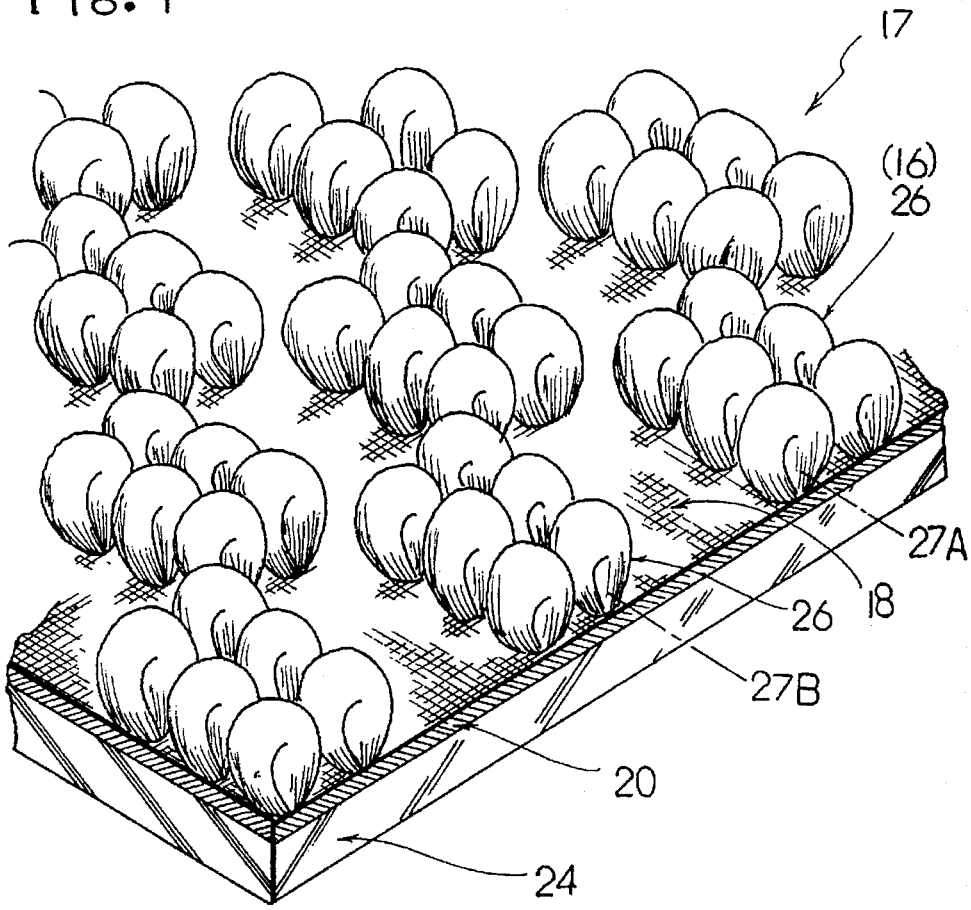
FIG. 1 is an elevational view of a floor carpeting comprising a composite elastic layer according to the present invention.

Referring to FIG. 1, a composite elastic layer 17 is illustrated. The composite elastic layer 17 is composed of loop pile tufted fabric. The loop pile tufted fabric is made from a backing fabric 20 and a plurality of loop piles 16 that are tufted to form a pile stratum (11). The elastomer composition is applied in a manner such that spaces 15 and 18 remain between at least some of the pile rows 27A and 27B, and in a manner to infiltrate into voids 14 between the plurality of fibers 13 of the loop pile 16. However, at least some of the voids 14 will remain to form a plurality of microscopic void spaces 14 between some of the fibers 13 of the loop pile 16. Thus, a grain 26 is formed as a one-piece body together with the loop pile 16. The elastomer composition infiltrated into the voids 14 links the fibers 13 of the loop pile 16 together to form a three-dimensional mesh structure in the interior of the loop pile 16.

The loop pile 16 can be made from organic fibers, for instance, wool fibers, polyester fibers, nylon fibers, polyacrylic fibers and polyolefin fibers, which are conventionally used as a pile yarn for a carpet. In addition, the loop pile 16 can be made from inorganic fibers, such as glass fibers, carbon fibers and metal fibers. Fiber 13 may be thicker than that of conventional pile yam for carpets which typically are of 5 to 20 denier.

The liquid elastomer composition 12 may be one of the various types of lattices (or emulsions), dispersions or sols and solutions of polymers. For example, natural latex, polychloropren(neoprene) latex, acrylonitrile-butiadiene latex, methyl-methacryl-butadiene latex, styrene-butadiene latex, acrylonitrile-butadiene-styrene latex, polyacrylate emulsions, polyvinyl-acetate emulsions, ethylene-vinylacetate emulsions, ethylene-vinylchloride emulsions, polyester emulsions, polyurethane emulsions, polyvinyl-chloride emulsions, polyvinyl-chloride paste, atactic polypropylene or bitumen may be used.

The liquid elastomer composition 12 is prepared to have a viscosity of less than 5000 cps at 20° C., preferably less than 2000 cps at 20° C. The viscosity can be varied by adjusting the amount of solvent or plasticizer. In a preferred embodiment, composition 12 has a viscosity of less than 1500 cps at 20° C. so as to infiltrate into the spaces 15 and 18 between loop piles and into the voids 14 between adjacent fibers 13 of each loop pile 16.

Various kinds of agents, for example, dispersants, stabilizers, foaming agents, flowing agents, anti-foaming agents, coagulants, gelling agents, hert steusitizers, vulcanizing agents, accelators, activators, antioxidants, antiozonants, soft fillers, heavy fillers, coloring agents, fire retardant agents and the like, may be mixed into the elastomer composition 12 depending on the properties of the elastomer composition 12 or the properties desired in the final composite elastic layer 17.

The elastomer composition 12 may be applied to the loop pile fabric in various manners, for instance, dipping, coating or spraying. After the elastomer composition is applied and has not yet cured or become solid, it is preferred to press the pile stratum 11, preferably with rolls, to cause the elastomer 12 to infiltrate into the voids 14 between adjacent fibers 13 of the loop pile 16. The rolls may be nip rolls, mangle rolls, squeeze rolls or the like. The pressing causes the pile stratum 11 (or the loop pile 16) to absorb the elastomer composition when the loop pile 16 recovers its original thickness or dimensions, due to its elastic property, after the press is removed. When the loop pile recovers to its original thickness, microscopic voids 14 will be formed between adjacent fibers 13.

After the pile stratum 11 has recovered to its original thickness or dimensions, the elastomer composition 12 sets (i.e., it dries or cures) so as to form a solid skin that sticks on, wraps over, and links the fibers 13 of the loop pile 16 together. Thus, the solid skin 12 on the fiber 13 forms a wall of cellular plastic material similar to rubber foams and reinforces the elastic property of the loop pile 16. On the other hand, the fiber 13 of the loop pile 16 reinforces the tensile strength, especially the resistance to tearing, of the solid skin 12. Thus, a composite elastic material 17, made in accordance with the present invention, has properties of a loop pile fabric and of a cellular plastic material and also of a viscoelastic material, so that it is very useful, not only as a floor covering, but also as a sound proofing material.

The preferred methods of forming the voids 14 and spaces 15, 18 in the composite elastic materials according to the present invention will be described below.

The amount of the elastomer composition 12 applied to the loop pile fabric, is adjusted so that:

(a) corresponds to the gross volume of the composite stratum 11 and is comprised of the elastomer composition 12 and the pile stratum 11;

(b) corresponds to the total volume of the gross volume of the voids 14 that remains between the fibers 13, which is made from the elastomer composition 12 and the loop pile 16, and will preferably be in the ratio of 100:5~95 when compared to the gross volume of the composite stratum (i.e., (a):(b));

(c) corresponds to the gross volume of the composite stratum 11;

(d) corresponds to the gross volume of the spaces 15 and 18 between the grains 26 and will preferably be in the ratio of 10:5~9 (i.e., (c):(d));

(e) corresponds to the gross volume of the grain 26; and (f) corresponds to the gross volume of the voids 14 and will preferably be in the ratio of 10:1~8 (i.e., (e):(f)).

To achieve these desired ratios, it is generally advisable that an amount of 50 to 500 parts in weight, preferably 150 to 500 parts in weight of the elastomer composition be applied to an amount of 100 parts in weight of the pile stratum. Additionally, it is also advisable to make the loop pile fabric pass through a squeeze type of apparatus after the application and before the elastomer composition has become solid.

It is further advisable, especially for the remaining space 18 between the pile rows 27A and 27B, to prepare the loop pile fabric in such a way that:

in the first case, the loop pile fabric is produced by a rough gauge tufting machine, wherein a plurality of needles are aligned in the rough needle gauge having more than a 5/32 inch gauge, in the second case, the loop pile fabric is produced by a fine gauge tufting machine, wherein a plurality of needles are aligned in the fine needle gauge having less than a 5/32 inch gauge, in a manner such that pile yarns are threaded into several adjacent needles, except for one subsequent or several adjacent needles in turn, or in a third case, the loop pile fabric is changed its arrangement of pile rows of fine gauge tufted fabric in a manner such that one or several adjacent pile rows are removed by pulling out these one or several back stitchs 19 without pulling out subsequent one or several back stitchs of pile rows 27 so that the formation of the pile stratum 11 is preserved with pile rows 27A and 27B remaining, and a wide space 18 is then formed between the remaining pile rows 27A and 27B.

In the latter two cases, it is advisable to tuft the loop pile in a zig-zag manner, such as for instance, as disclosed in U.S. Pat. No. 3,026,830 so that large spaces 18 are formed not only between the pile rows 27 in the lateral direction of the loop pile fabric, but also between the loop piles 16 in each pile row 27. That is, in the longitudinal direction, as shown in FIG. 1 where, two pile rows were removed and a subsequent two pile rows remain, and each pile row 27 was shifted by two needle gauges in the lateral direction for every three needle stroke cycles.

Of course, the width of spaces 15 and 18 between the pile rows 27A and 27B are variable according to not only (a) the gauge between the pile rows 27, that is, the needle gauge of the tufting machine, but also (b) the thickness of the pile yarn 20 for forming the loop pile 16, (c) the pile height of the loop pile, and (d) the amount of elastomer composition 12 that is applied to the loop pile fabric.

Thus, it is advisable to set up suitably these factors ((a), (b), (c) and (d)), that is, (a) the needle gauge, (b) the thickness of the pile yarn, (c) the pile height, and (d) the amount of the elastomer composition so that the space 18 has a width of at least 1 mm, preferably more than 3 mm, and generally about 4~20 mm, formed between the pile rows 27 in the final composite elastic layer 17.

Figure 2:
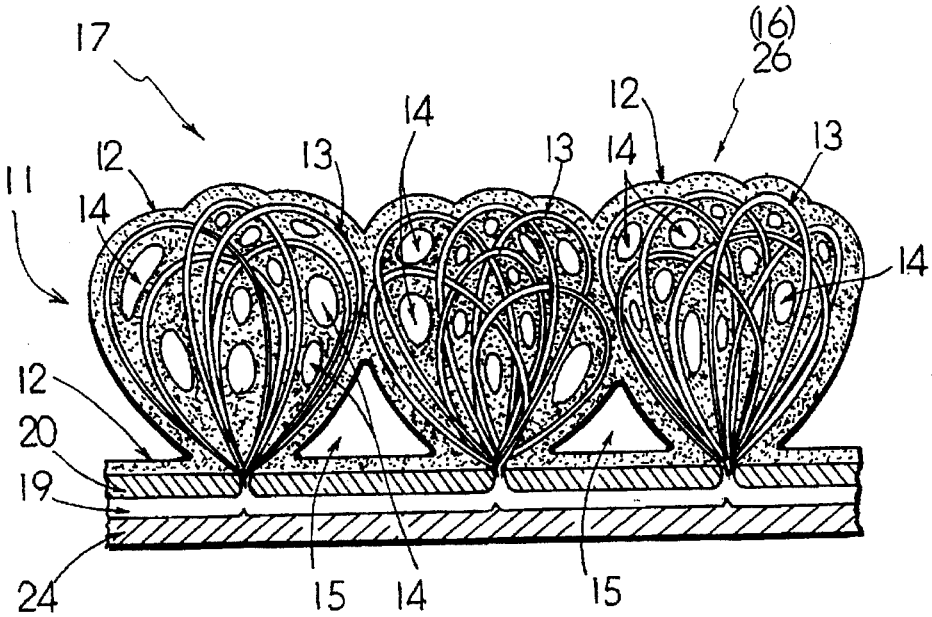
FIG. 2 is a schematic sectional view of a floor carpeting comprising a composite elastic layer according to the present invention.
Figure 3:
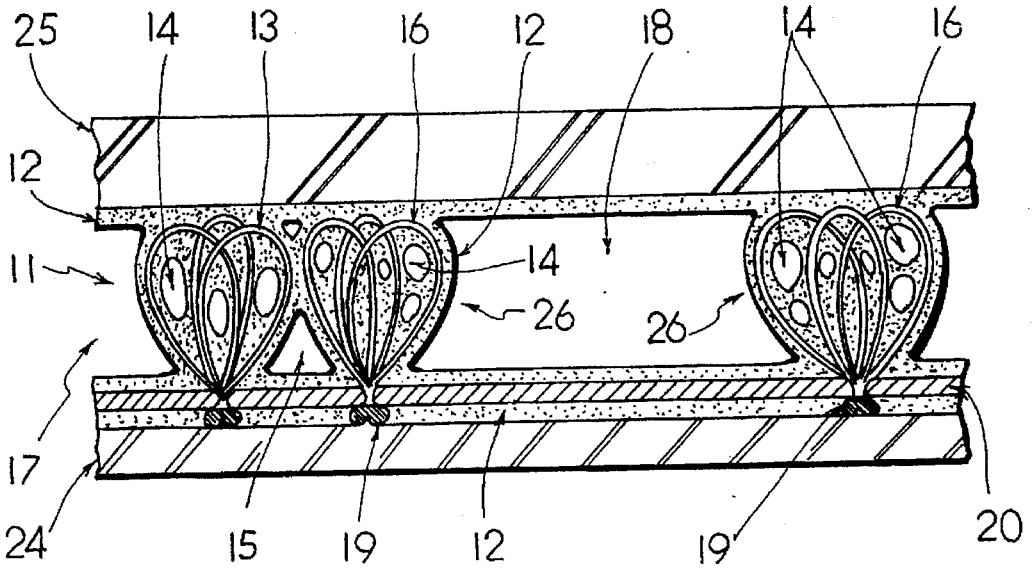
FIG. 3 is a schematic sectional view of a floor carpeting comprising a composite elaster layer according to the present invention.
Figure 4:
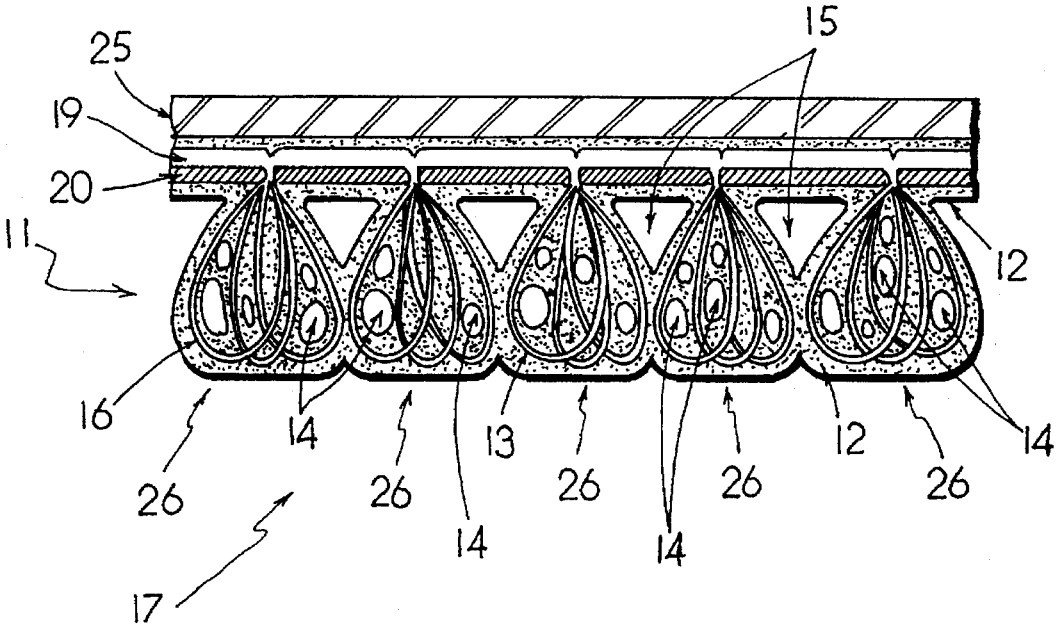
FIG. 4 is a schematic sectional view of a floor covering comprising a composite elastic layer according to the present invention.

The composite elastic layer, in accordance with the present invention, may be used as a floor covering and a sound proof material suitably by adhering the elastic layer to an under layer or a base material 24. For instance, a polyvinyl-chloride resin layer, a board, and a plate, can be applied to its back stitch side surface as shown in FIGS. 1 and 2. Additionally, the composite elastic layer may be used as an under layer by adhering a top layer or a floor covering 25. For example, a conventional plain fabric, a conventional pile fabric, an artificial turf and an artificial leather can be applied to its back stitch side surface as shown in FIG. 4. In addition, by adhering both the top layer 25 and the under layer 24 to both sides of the composite elastic layer, as shown in FIG. 3, a floor board, for example, can be assembled.

The present invention is illustrated by the following non-limiting examples, wherein the word of "part(s)" is defined to be dry part in weight.

EXAMPLE 1

A loop pile tufted fabric, which is formed from a pile yarn made from nylon fiber 13 and a non-woven backing fabric 20 made from polyester fibers, and which had a gross weight of a pile stratum of 245 g/m$^2$ was used. The pile height was 5 mm. The fabric was prepared by changing an arrangement of pile rows of a loop pile tufted undisguised fabric, which was produced with a tufting machine having a needle gauge of 1/10 inch, in a manner such that two adjacent pile rows of every four adjacent pile rows, which were in adjacent in the lateral direction, were removed away by pulling out their back stitches so that a wide space, where the two pile rows had been stuck, would be formed between every two pile rows.

A liquid elastomer composition having a viscosity of 1,100 cps at 20° C. was prepared from the following components.

| | |
|---|---|
| Polyvinylchloride paste (degree of polymerization 1700) | 100 parts |
| Plasticizer DOP | 40 parts |
| Plasticizer DINP | 40 parts |
| Epoxydized soybean oil (stabilizer) | 3 parts |
| Di(n-octyl)tin-5,5' - bis (isooctyl mercaptoacetate) (stabilizer) | 2 parts |
| Pigment Green | 2 parts |

The loop pile rafted fabric was fed into a bath of the liquid elastomer composition.

After exiting the bath, the loop pile tufted fabric passed through squeeze rolls so that the air was forced out of the loop pile 16 and the liquid elastomer composition 12 was absorbed into the voids 14 between the fibers 13 of the loop pile 16. Thereafter, the liquid elastomer composition 12, which is applied to the loop pile tufted fabric, was treated at 180° C. for 10 minutes.

A composite elastic layer 17, having a gross weight of a composite stratum of 742 g/m$^2$, which is useful as a bath mat, was obtained.

EXAMPLE 2

A liquid elastomer composition having a viscosity of 15,000 cps at 20° C. was prepared from the following components.

| | |
|---|---|
| Polyvinylchloride paste (degree of polymerization 1400) | 100 parts |
| Plasticizer DINP | 70 parts |
| Epoxydized soybean oil (stabilizer) | 3 parts |
| Di(n-octyl)tin-5,5' -bis(isooctyl mercaptoacetate) (stabilizer) | 2 parts |
| Calcium Carbonate (filler) | 40 parts |
| Calcium oxide (anti-flowing agent) | 2 parts |
| Pigment black (carbon black) | 1 part |

The liquid elastomer composition was coated over a Teflon (poly-tetra-fluoroethylene) belt to form a liquid coating layer 24 having a 2 mm thickness. The composite layer obtained in EXAMPLE 1 was laid over the liquid coating layer. Thereafter, the liquid coating layer 24 was treated at 180° C. for 6 minutes so as to turn into the solid underlayer 24 that was attached to the back stitch side surface 19 of the composite layer 17 obtained in EXAMPLE 1.

A floor mat was obtained.

EXAMPLE 3

A loop pile tufted fabric was formed from a pile yarn made from nylon fiber 13 and a non-woven backing fabric 20 made from polyester fibers, which had a gross weight of a pile stratum of 171 g/m$^2$. The pile height was 4 mm, and the gauge, between pile rows 27 was 1/5 inch. A tufting machine having a needle gauge of 1/10 inch, wherein a pile yarn was threaded into every one needle, wherein, in turn, one of the adjacent two needles had a pile yarn but the other adjacent needle did not have a pile yarn (see FIG. 5).

Figure 5:
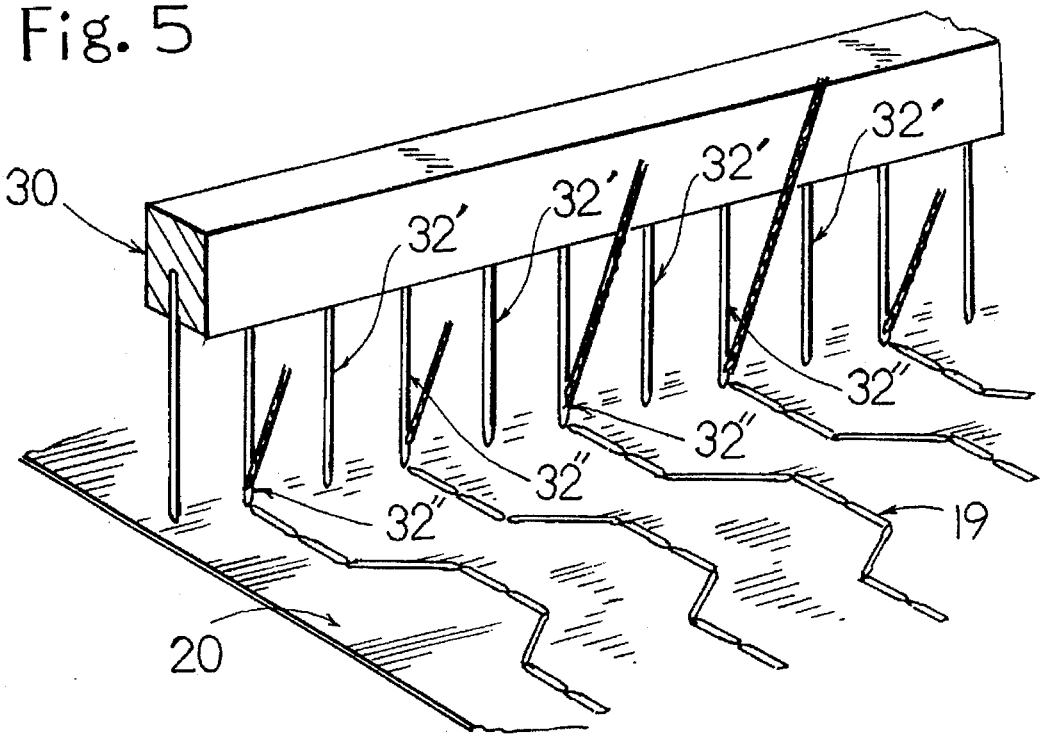
FIG. 5 is a perspective view of a tufting machine.
Figure 6:
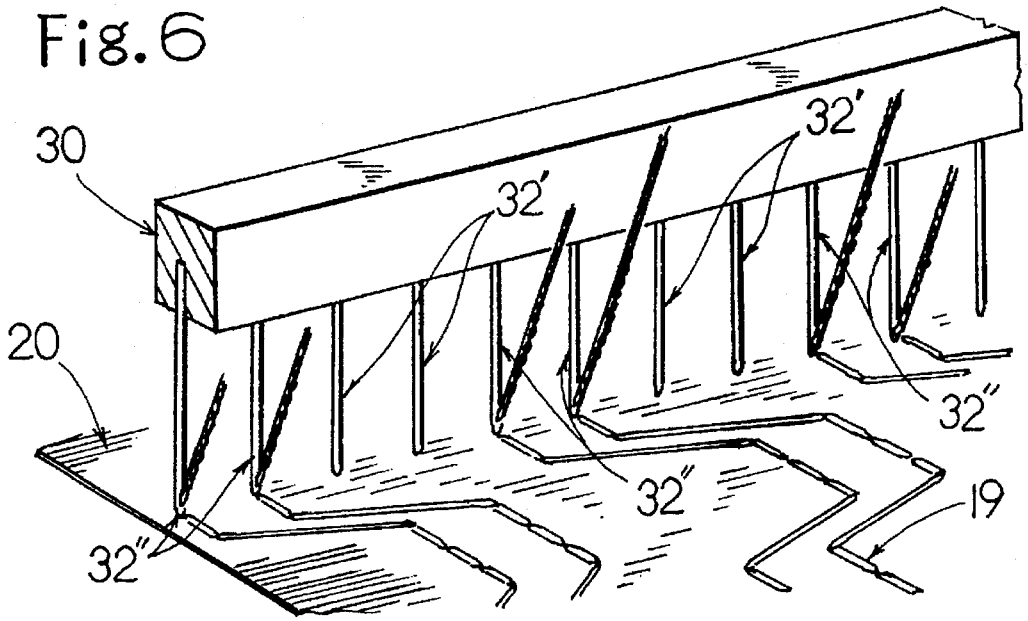
FIG. 6 is a perspective view of a tufting machine.

The tufting machine illustrated in FIGS. 5 and 6 include a needle bar 30, having a plurality of needles 32 depending downwardly therefrom. The needles identified as 32' are unthreaded and the needles identified as 32" are threaded.

A liquid elastomer composition was prepared from the following components by adjusting with water so as to have a viscosity of 200 cps at 20° C. and a total solid content of 45% (by weight).

| | |
|---|---|
| 50% polychrprene latex (Neoprenen 842A . DuPont) | 100 parts |
| 50% Zinc oxide Dispersion | 5 parts |
| 50% Sulfur Dispersion | 1 part |
| 50% Thiocabanilide Dispersion | 1 part |
| 50% Zinc diethyl dithiocarbamate Dispersion | 2 parts |
| 10% Potassium-hydroxide Dispersion | 0.5 parts |
| 40% 4-4'-thio-bis-(6-t-butyl-m-cresol) Dispersion (Antioxidant) | 70 parts |
| 20% Sodium-alkyl-sulphate Dispersion | 1 part |
| 50% Polyoxy-ethylene-alkyl-phenyl-ether Dispersion (Stabilizer) | 1 part |
| 50% Antimony trioxide Dispersion (Fire retardance | 10 parts |
| 40% Pigment black Dispersion (Carbon black) | 2 parts |
| Silicone (Antifoaming) | 0.05 parts |

The liquid elastomer composition was sprayed over the surface of the pile stratum 11 of the loop pile tufted fabric. Thereafter, the loop pile tufted fabric passed through squeeze rolls. After squeezing, the liquid elastomer composition absorbed into the loop pile tufted fabric and was dried at 130° C. for 15 minutes.

A composite layer 17, having a gross weight of a composite stratum of 531 g/m$^2$, which was useful as a trunk room mat for a car, was obtained.

EXAMPLE 4

The back stitch side surface 19 of the composition elastic layer 17 obtained in EXAMPLE 3 was attached to an undersurface of an artificial turf 25 with the adhesive prepared from the following components by adjusting with water to have a viscosity of 100 cps at 20° C. with a total solid content of 40% (by weight).

| | |
|---|---|
| 45% Carboxylated Methyl-methacryl-butadiene-copolymer latex | 100 parts |
| 50% Zinc oxide Dispersion | 2 parts |

-continued

| | |
|---|---|
| 40% 4-4'-thio-bis-(6-t-butyl-m-cresol) Dispersion | 1 part |
| Silicone | 0.02 parts |

Thereafter, the adhesive was dried at 150° C. for 10 minutes.

EXAMPLE 5

The loop pile tufted fabric, having a gross weight of a pile stratum of 171 g/m$^2$ with a pile height of 4 mm and a gauge between pile rows of ⅕ inch, was produced in the same manner as in EXAMPLE 3.

A liquid elastomer composition was prepared from the following components by adjusting with water so as to have a viscosity of 150 cps at 20° C. with a total solid content of 50% (by weight).

| | |
|---|---|
| 60% Natural rubber latex | 100 parts |
| 50% Sulphur Dispersion | 1 part |
| 50% Zinc Oxide Dispersion | 1 part |
| 40% 4,4-thio-bis-(6-t-butyl-m-cresol) Dispersion | 2 parts |
| 30% Polyoxy-ethylene-alkyl-phenyl-ether Dispersion | 1 part |
| 10% Potassium-hydroxide Dispersion | 0.5 parts |
| 40% Wax Dispersion | 2 parts |
| 40% Pigment blue Dispersion | 2 parts |
| Silicone | 0.02 parts. |

The loop pile tufted fabric was fed into a bath of the liquid elastomer composition.

After exiting the bath, the loop pile tufted fabric passed through squeeze rolls so that the air was forced out of the loop pile 16 and the liquid elastomer composition 12 was absorbed into the voids 14 between the fibers 13 of the loop pile 16.

After squeezing, the liquid elastomer composition absorbed into the loop pile tufted fabric and was dried at 150° C. for 10 minutes.

A composite elastic layer 17, having a gross weight of a composite stratum of 513 g/m$^2$, which was useful as a carpet underlayer, was obtained.

EXAMPLE 6

The loop pile tufted fabric, having a gross weight of a pile stratum of 171 g/m$^2$, with a pile height of 4 mm and a gauge between pile rows 27 of ⅕ inch, was produced in the same manner as in EXAMPLE 3.

A liquid elastomer composition was prepared from the following components by adjusting with water to have a viscosity of 100 cps at 20° C. with a total solid content of 40% (by weight).

| | |
|---|---|
| 45% Carboxylated acrylonitrile-butadiene copolymer latex | 100 parts |
| 50% Sulphur Dispersion | 1 part |
| 50% Zinc oxide Dispersion | 3 parts |
| 50% Zinc diethyl dithiocarbamate Dispersion | 1 part |
| 40% 4,4' -thio bis- (6-t-butyl-m-cresol) Dispersion | 2 parts |
| 30% Polyoxy ethylene alkyl phenyl ether Dispersion | 1 part |
| 40% Pigment Blawn Dispersion (Ferric oxide) | 1 part |
| Silicon | 0.02 parts |

The loop pile tufted fabric was fed into a bath of the liquid elastomer composition and treated in the same manner as in Example 5.

A composite elastic layer 17 having a gross weight of a composite stratum of 427 g/m$^2$, which was useful as a carpet underlayer, was obtained.

EXAMPLE 7

The liquid elastomer composition prepared in EXAMPLE 2 was coated on a Teflon belt to form a liquid coating layer having a 2 mm thickness.

The composite elastic layer 17 obtained in EXAMPLE 6 was laid over the liquid coating layer.

Thereafter, the liquid coating layer was treated in the same manner as in EXAMPLE 2.

A floor mat was obtained.

EXAMPLE 8

The loop pile tufted fabric, having a gross weight of a pile stratum of 220 g/m$^2$, with a pile height of 5 mm and a gauge between pile rows of ⅕ inch, was produced in the same manner as in EXAMPLE 3, except for the use of a polyester fiber pile yarn in place of the nylon fiber pile yarn.

The loop pile tufted fabric was fed into a bath of the liquid elastomer composition prepared in EXAMPLE 3, and treated in the same manner as EXAMPLE 5, except that it was dried at 150° C. for 15 minutes.

A composite elastic layer 17, having a gross weight of a composite stratum of 550 g/m$^2$, which was useful as a floor covering underlayer, was obtained.

EXAMPLE 9

The back stitch side surface 19 of the composition elastic layer 17 obtained in EXAMPLE 8 was attached to an undersurface of a wood floor board 25 with an adhesive made of polyvinyl-acetate emulsions and was dried.

A floor board, having a sound proof property, was obtained.

EXAMPLE 10

A loop pile tufted fabric, which was formed from a pile yarn made from polyester fiber 13 and a non-woven backing fabric 20 made from polyester fibers, was used. A stripe pattern was formed over the non-woven backing fabric 20 with a pair of two pile rows with a ⅛ inch gauge between them and a wide space 18 of ⅜ inch in width between pairs of two pile rows. The tufted fabric, having a gross weight of a pile stratum of 160 g/m$^2$ with a pile height of 5 mm, was produced with a tufting machine having a needle gauge of 1/10 inch, wherein a pile yarn was threaded into two adjacent needles without threaded into subsequent two adjacent needles in turn (See FIG. 6).

The loop pile tufted fabric was fed into a bath of the liquid elastomer composition prepared in EXAMPLE 3 and was treated in the same manner as in EXAMPLE 5.

A composite elastic layer, having a gross weight of a composite stratum of 290 g/m$^2$, which was useful as a slip proof floor covering in a yacht, was obtained.

Having described the presently preferred exemplary embodiment of a new and improved composite elastic layer in accordance with the present invention, it is believed that other modifications, variations and changes will be suggested to those skilled in the art in view of the teachings set forth herein. It is, therefore, to be understood that all such variations, modifications, and changes are believed to fall within the scope of the present invention as defined by the appended claims.

We claim:

1. A composite elastic layer comprising:

a backing fabric;

a plurality of loop piles being tufted on said backing fabric by a tufting machine to form a pile stratum, wherein;

said plurality of loop piles form a plurality of pile rows, a space is formed between said pile rows;

each of said loop piles is made from a plurality of fibers, and each of said loop piles has a plurality of voids disposed between adjacent fibers in an interior of said loop pile, an elastomer composition being applied to said pile stratum such that;

said elastomer composition is absorbed in said pile stratum and infiltrates into all of said voids disposed in the interior of said loop pile, said elastomer composition sticks on and wraps over all fibers of each loop pile, some of said plurality of voids remain in the interior of said loop pile, said remaining voids reform a microscopic void surrounded by a skin of said elastomer composition sticking on and wrapping over said fibers in the interior of the loop pile, said skin of said elastomer composition sticking on and wrapping over said fibers links between adjacent fibers in the interior of the loop pile, and some of said spaces remain between adjacent some of said pile rows.

2. A composite layer as defined in claim 1, wherein the loop pile forms a grain being a one piece body together with said elastomer composition, which is absorbed in said pile stratum and infiltrates into all of said voids, and links between adjacent fibers in the interior of said loop pile.

3. A composite elastic layer as defined in claim 2, wherein the space has a width of at least 1 mm.

4. A composite elastic layer as defined in claim 3, wherein the space has a width of at least 3 mm.

5. A composite layer is defined in claim 2, wherein the loop pile is tufted in a zig-zag manner, and the space is formed between the pile rows in a lateral direction of the loop pile fabric and between the loop piles in each pile row in a longitudinal direction of the loop pile fabric.

6. A composite elastic layer as defined in claim 5, wherein the space has a width of at least 3 mm in the lateral direction of the loop pile fabric and a length of at least 3 mm in the longitudinal direction of the loop pile fabric.

7. A composite elastic layer as defined in claim 1, wherein an amount of 150 to 500 parts in weight of the elastomer composition is applied to an amount of 100 parts in weight of the pile stratum.

* * * * *